United States Patent [19]

Ohsawa et al.

[11] Patent Number: 5,059,935

[45] Date of Patent: Oct. 22, 1991

[54] SOLENOID COIL APPARATUS

[75] Inventors: Koichi Ohsawa; Masanori Ohmi, both of Anjo, Japan

[73] Assignee: Nippondenso Co., Ltd., Kariya, Japan

[21] Appl. No.: 564,281

[22] Filed: Aug. 8, 1990

[30] Foreign Application Priority Data

Aug. 8, 1989 [JP] Japan ..... 1-205099

[51] Int. Cl.[5] ..... H01F 5/00; H01F 15/10

[52] U.S. Cl. ..... 335/282; 335/299; 336/192

[58] Field of Search ..... 335/281, 282, 299; 336/192, 196, 198

[56] References Cited

U.S. PATENT DOCUMENTS 4,527,141 7/1985 Post ..... 336/192

FOREIGN PATENT DOCUMENTS 63-8087 3/1988 Japan .

OTHER PUBLICATIONS

Journal of Nippondenso Technical Disclosure 33-183, Jan. 1, 1983, Nippondenso Co. Ltd., Japan.

*Primary Examiner*—Harold Broome

*Attorney, Agent, or Firm*—Cushman, Darby & Cushman

[57] ABSTRACT

A solenoid apparatus having a bobbin, a core and a coil wound on a cylindrical body of the bobbin. A post of the bobbin has a slit elongated along the post and a groove. The end portion of coil is wound around the outer surface of the post by a predetermined space, and is welded to the core, so that the length of the end portion between the post and a welded portion becomes longer. The central line $l_1$ of the groove is eccentric to the axis $l_2$ of the post in such a manner that a radius of curvature in the end portion of the coil becomes larger.

7 Claims, 5 Drawing Sheets

SOLENOID COIL APPARATUS

FIELD OF THE INVENTION

The invention relates generally to a solenoid coil arrangements for the magnet switches of starters. More particularly it relates to the connections formed at an end portion of the coil.

DESCRIPTION OF THE PRIOR ART

A known starter's magnet switch arrangement is disclosed in the Open Technical Report of Nippondenso No. 33-183 (published on Jan. 15, 1984). As seen therein, CONVENTIONAL starter magnet switches typically have a bobbin about which a coil is wound and an iron core. As shown therein, an end portion of the coil is guided through a post which is integrally formed on the bobbin. The end portion is then welded to the surface of the iron core.

The portion of the coil between the post and the place the coil is welded to the surface of the iron core is swung by vibrations of the vehicle. Thus stresses tend to concentrate on the welded portion of the coil or on the portion in contact with the post. As a result, the end portion of the coil breaks down Our investigations have suggested that the stress concentration is much applied to the end portion of the coil, since the length of the coil between the post and the welded portion is too short.

SUMMARY OF THE INVENTION

It is therefore an object of the invention to provide a solenoid coil apparatus which has a long end portion of the coil.

It is another object of the invention to provide a solenoid coil apparatus which prevents the end portion of coil from breaking down.

According to one aspect of the invention, there is provided a solenoid coil apparatus, comprising a bobbin, a core and a coil. The end portion of the coil is loosely wound around the post to form a predetermined space therebetween.

The above and other objects, features and advantages of the invention will become more apparent from the following description and appended claims, taken in conjunction with the accompanying drawings which show by way of example some preferred embodiments of the invention.

DETAILED DESCRIPTION OF THE PREFERRED EMBODIMENTS

The present invention will now be explained with reference to the drawings showing embodiments of the present invention.

Figure 9:
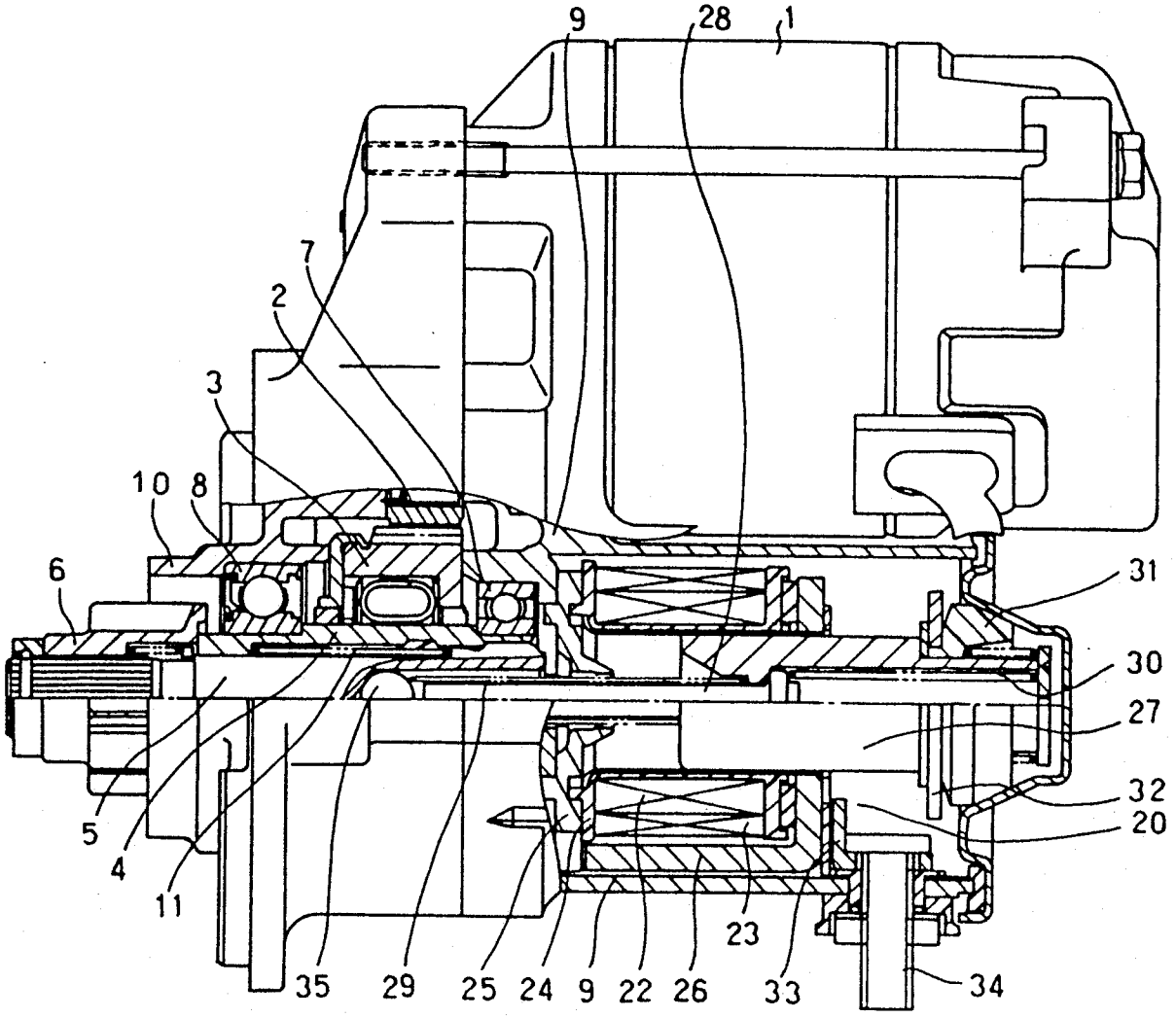
FIG. 9 is an elevational view, partly in cross section, of an internal combustion engine starter.
Figure 10:
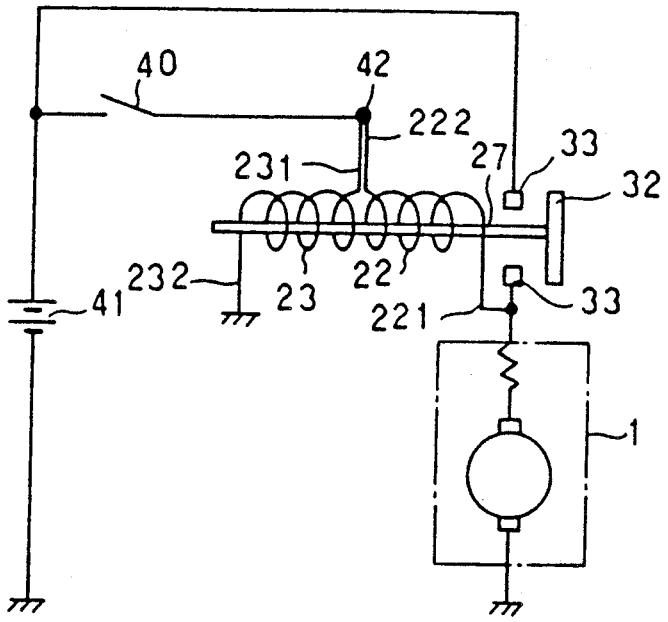
FIG. 10 is an electric circuit diagram of the starter.

In FIGS. 9 and 10, numeral 1 designates a starter motor having an armature shaft (not shown). An over-running clutch 3 meshes with an idle gear 2 which is fixed to the armature shaft, and transmits the rotational force from the armature shaft of the motor to a spline tube 4.

The spline tube 4 is rotatably supported by a housing 9 and a solenoid housing 10 through a pair of bearings 7 and 8. A shaft 5 is inserted into the spline tube 4 and is engaged therewith through helical splines. Thus the shaft 5 is rotatably and slidably supported within the spline tube 4.

A pinion 6 is mounted on the forward end 51 of the shaft 5 and is brought into engagement with ring gear (not shown) of an internal combustion engine when the starter is operated.

A return spring 11 is inserted within the spline tube 4 so that the pinion 6 is returned in a predetermined position by a spring force of the return spring 11.

A magnet switch 20 is arranged coaxially with the shaft 5 and the pinion 6 within the solenoid housing 9. A solenoid 21 has a bobbin 24, and a core. The core includes a ground plate 25 and a core plate 26.

An attracting coil 22 and a holding coil 23 are wound about the bobbin 24. The ground plate 25 and the core plate 26 are used as a magnetic flux path of the coils 22 and 23. A plunger 27 is axially slidably held within a center bore of the bobbin 24, so that the plunger 27 is pulled into the bobbin bore when the coils 22 and 23 are energized.

A rod 28 is operatively connected to the plunger 27 in such a manner that one end of the rod 28 is engaged with the shaft 5 through a ball 35 held in a bore formed in the shaft 5. A movable contact 32 is fixed to the opposite end of the rod 28 through an insulate member 31. A pair of fixed contacts 33, respectively, are fixed on the solenoid cover 9 by means of a bolt 34 as to face the movable contact 32. A return spring 29 is arranged between the ball 35 and the plunger 27 and a drive spring 30 is arranged within the plunger 27.

The operation of the starter will be explained in FIGS. 9 and 10. When a starter switch 40 is closed to energize the attracting coil 22 and the holding coil 23 from a battery 41, the plunger 27 is pulled to the right side against the spring force of the return spring 29. In accordance with the movement of the plunger 27, the shaft 5 is pushed in a forward direction so as to engage the pinion 6 with the ring gear. At the same time, a movable contact 32 fixed to the plunger 27 is brought into engagement with the fixed contacts 33, and electric power is supplied to the starter motor 1 from the battery 41 to start the starter motor 1.

When the starter motor 1 begins to rotate, its rotational force is transmitted to the spline tube 4 through the idle gear 2 and the over-running clutch 3. The rotational force of the spline tube 4 is transmitted to the pinion 6 through the shaft 5, and then to the ring gear, so that the internal combustion engine is cranked.

When the starter switch 40 is opened after cranking the internal combustion engine, the plunger 27 is returned by the spring force of the return spring 29, and the starter motor 1 stops. The pinion 6 is separated from the ring gear and is returned in a predetermined position by the spring force of the return spring 11.

The solenoid 21 of the magnet switch 20 will be explained with reference to FIGS. 1 to 8.

Figure 4:
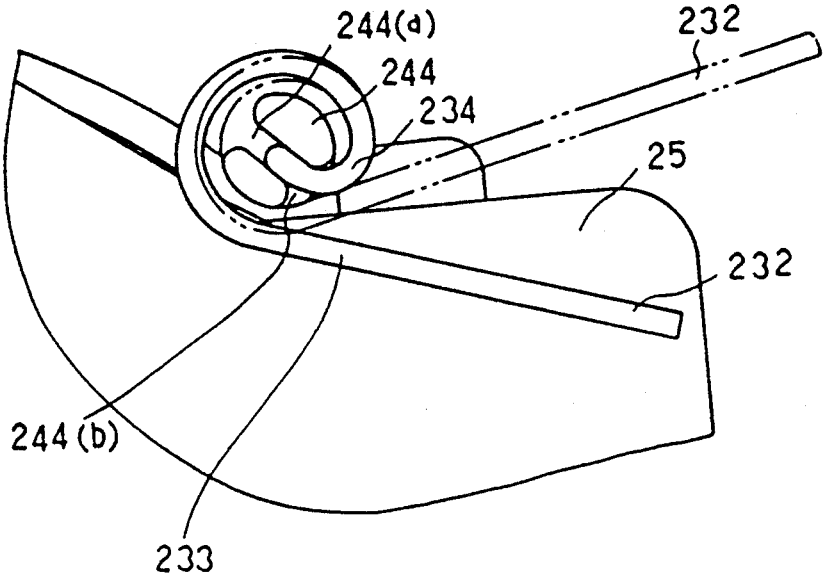
FIG. 4 is an enlarged plan view showing the state in which the end portion of the coil is wound around the post.
Figure 7:
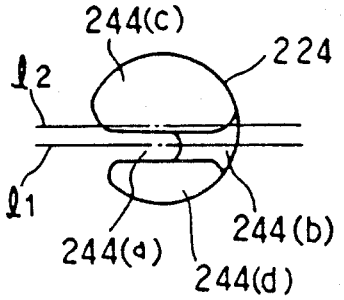
FIG. 7 is an enlarged plan view showing the post shown in FIG. 6.

The bobbin 24 is made of resin, has a first circular flange 241, a second circular flange 242 and a cylindrical body 243 between the first and second flanges 241 and 242. A pair of posts 244, 245 protrude axially outwardly from the first flange 241. Each post has slit 244(*a*), 245(*a*) respectively. The width of the slits are larger than the diameter of the holding coil 23. A groove 244(*b*) is formed in the top end of the post 244. As shown in FIG. 7, a center line $1_1$ of the groove 244(*b*) is offset relative to the axis $1_2$ of the post 244 by a predetermined amount to divide the top end of the post 244 into larger and smaller segments 244(*c*), 244(*d*). The posts 244 and 255 are axially protruded on the first flange 241 in such a manner that the center line $1_1$ of the groove 244(*b*) is substantially parallel to an outer surface of the first flange 241, as shown in FIG. 4.

Figure 1:
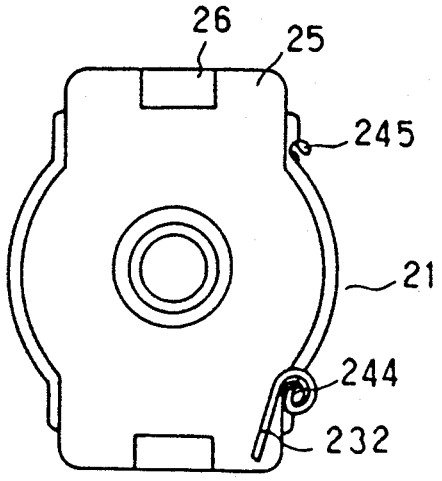
FIG. 1 is a side view showing one embodiment of the solenoid coil apparatus in accordance with the present invention.
Figure 2:
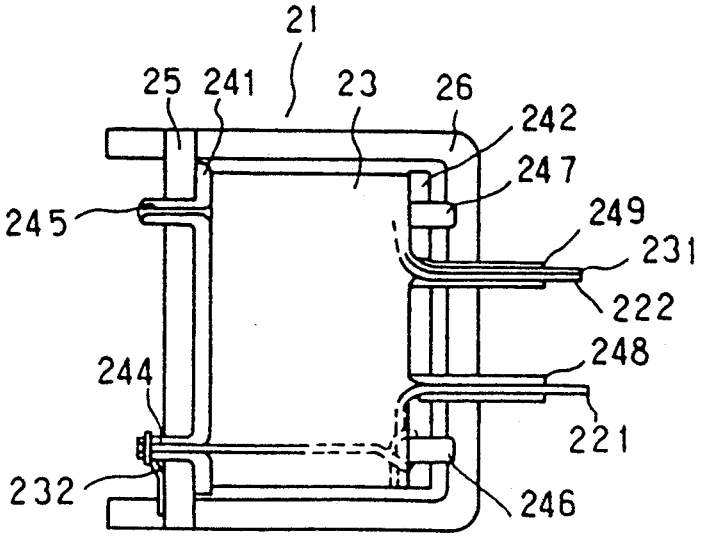
FIG. 2 is a plan view of the solenoid coil apparatus shown in FIG. 1, FIGS. 3 to 5 highlight the manner in which the end portion of the coil wrapped around the bobbin post.

As shown in FIG. 2, a pair of projections 246 and 247 are formed on the second flange 242 so as to face respectively the posts 244 and 245 on first flange 241. A first and second guides 248, 249 are also formed on the second flange 242 so as to guide the opposite ends portions 221 and 222 of the attracting coil 22 and end portion 231 of the holding coil 23 through grooves of the guides 248 and 249.

The winding of the coils will be explained next with reference to FIGS. 2–5. The wire that forms the attracting coil 22 is initially threaded through the first guide 248. It is then wound around the cylindrical body 243 of bobbin 24. Once the desired number of turns have been wound, the wire is threaded out of the solenoid through second guide 249 to complete the coil. (FIG. 2)

Figure 3:
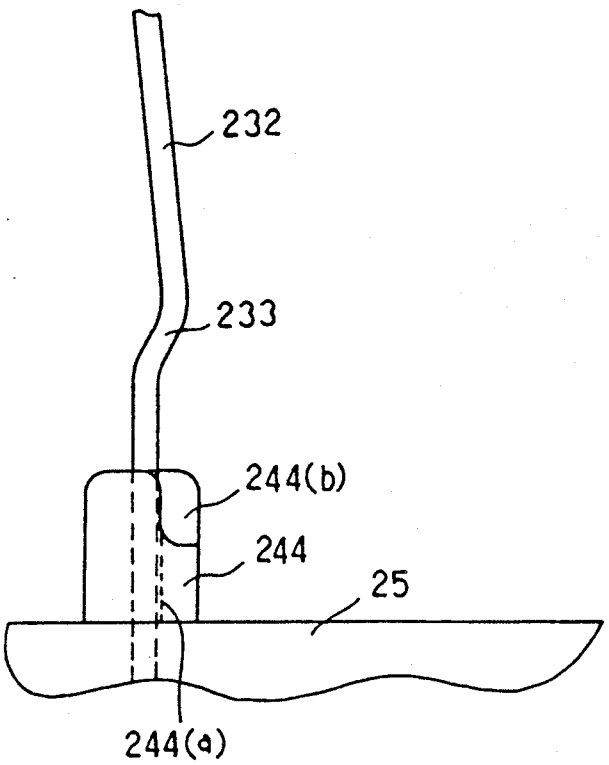
FIG. 3 is an enlarged side view showing the state in which the end portion of the coil is initially protruded from the post.

Once the attracting coil 22 has been completed, the wire intended to form the holding coil 23 is threaded into the solenoid 21 through the second guide 249. The desired number of holding coil 23 turns are then wound about the attracting coil 22. Once the holding coil 23 has been wound, the wire is wrapped around the first projection 246 (is anchored by wrapping it around the first projection 246), as seen in FIG. 2. It is then extended longitudinally to pass through the slit 244(*a*) in post 244, as seen in FIG. 3.

The ground plate 25 is provided on the surface of the first flange 241 in such a manner that a recess portion 251 of the ground plate 25 engages a circular lip 241(*a*) of the first flange 241.

The core plate 26 is arranged to cover both the second flange 242 of the bobbin 24 and the holding coil 23, and is fixed to the ground plate 25 so that the bobbin 24 is strictly fixed between the ground plate 25 and the core plate 26. The posts 244 and 245 extend above the ground plate 25. Similarly, the guides 248, 249 extend above the core plate 26.

The wire is then bent to form a bend 233 slightly beyond the point 234 at which it emerges from the slit 244(*a*). (FIG. 3). It is then past through groove 244(*b*) and wound around the post 244 to substantially the position shown in broken lines in FIGS. 4 and 5. The wire is then placed on the ground plate 25 and fixed thereto by electric welding in the position shown in solid lines in FIGS. 4 and 5. It is noted that when the wire is moved from the broken line position to the solid line position, a space is formed between the coil wire and the post 244. The wire is also cut so that a predetermined length of wire 235 is available for welding to the ground plate 25.

Figure 6:
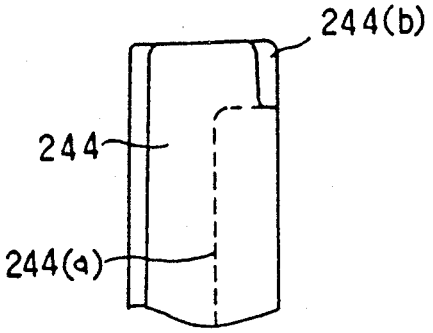
FIG. 6 is an enlarged side view showing the post.

The second end 222 of the holding coil 22 and the first end 231 of the attracting coil 23 are connected to the key switch 40, which in turn is connected to the battery 41 through a starter terminal 42(see FIG. 6). The first end 221 of the attracting coil 22 is connected to the connecting portion between the fixed contact 33 and the starter motor 1.

Figure 8:
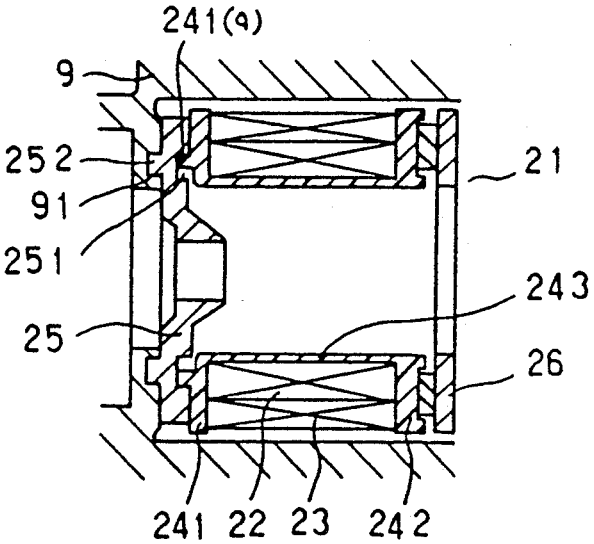
FIG. 8 is a sectional view showing the solenoid coil apparatus of the present invention.

As shown in FIG. 8, since the solenoid 21 is assembled within the solenoid housing 9 in such a manner that a rim 252 of the ground plate 25 is engaged with a recess portion 91 of the solenoid housing 9, the second end 232 of the holding coil 23 is grounded to the solenoid housing 9 through the ground plate 25.

Since the holding coil's second end 232 is wound around the outer surface of post 244, the section of wire between point 234 where the wire emerges from the post 244 and the portion 235 welded to the ground plate 25 is relatively long. This distance is further enhanced by the bend 233. Accordingly, stress concentrations in the second end section 232 due to vibrations in the vehicle are remarkably decreased.

Figure 5:
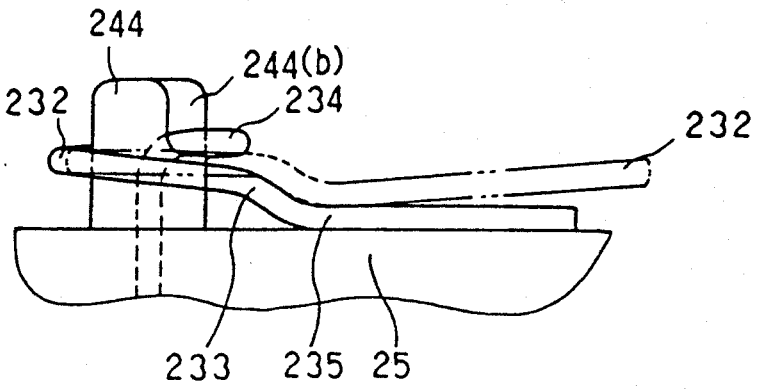
FIG. 5 is an enlarged side view showing the state in which the end portion of the coil is wound around the post shown in FIG. 4.

As shown in FIG. 5, the bend 233 on the second end 232 also serves to lengthen the section between the portion 234 and the welded portion 235.

As shown in FIG. 7, since the center line $1_1$ of the groove 244(*b*) is offset with respect to the axis line $1_2$ of the post 244, the coil 23 is wound around a periphery of the post 244 in such a manner that the coil is initially wound about the larger segment 244(*c*). The coil 23 provides an increased radius of curvature in the coil between the guide 244(*b*) and the periphery of the post 244. Accordingly, the stress concentration applied to the portion 234 is also decreased.

Since the coil wire engages the first projection 246, it can be easily inserted into the slit 244(*a*) of the post 244.

In accordance with the various types of the starter, the other end portion 232 of the holding coil 23 is guided into either the post 244 or the post 245.

What is claimed:

1. A solenoid coil apparatus for an internal combustion engine starter comprising:

a bobbin having a cylindrical body, a flange formed on an end of said cylindrical body, and a post which is formed on said flange, and said post having a slit extending longitudinally through said post;

a core provided on a surface of said bobbin flange; and a coil wound about said cylindrical body, and having an end portion which is inserted into said slit of said post;

wherein said end portion of said coil has a fixed portion which is fixed to said core, and a wound portion which is loosely wound around said post by a predetermined space.

2. A solenoid coil apparatus as claimed in claim 1, wherein:

said post has a groove on a top end in such a manner that a center line of said groove is offset relative to an axis of said post by a predetermined amount, and said wound portion provides an increased radius of curvature.

3. A solenoid coil apparatus comprising:

a wound coil having an end portion;

a bobbin having:

a) a cylindrical body about which said coil is wound;

b) first and second flanges provided on opposite ends of said cylindrical body; and c) a post protruding from said first flange, and having guiding means for guiding said end portion of said coil so as to loosely wind said end portion around said post in such a manner that a radius of curvature of said wound end portion is increased as it is further wound around said post; and a core provided on said first flange, to which a fixed portion of said end portion is fixed after being wound around said post.

4. A solenoid coil apparatus as claimed in claim 3, wherein said guiding means includes an elongated slit extending longitudinally through said post and a groove formed on said post in such a manner that a center line thereof is offset relative to an axis of said post by a predetermined amount.

5. A solenoid coil apparatus as claimed in claim 3, wherein said guiding means includes an elongated slit extending longitudinally through said post and a groove formed on said post in such a manner that a center line thereof is offset relative to an axis of said post by a predetermined amount to divide a top end of said post into larger and smaller segments.

6. A solenoid coil apparatus as claimed in claim 3, wherein said end portion of said coil has a bend between said fixed portion and a wound portion of said end portion which is loosely wound around said post.

7. A solenoid coil apparatus comprising:

a wound coil having an end portion;

a bobbin having:

a) a cylindrical body about which said coil is wound;

b) first and second flanges provided on opposite ends of said cylindrical body; and c) a post protruding from said first flange, on which a groove is formed in such a manner that a center line thereof is offset relative to an axis of said post by a predetermined amount so as to loosely wind said end portion around said post so that said end portion is separated from said post by a predetermined space; and a core, provided on said first flange, to which a fixed portion of said end portion is fixed after being wound around said post.

* * * * *

UNITED STATES PATENT AND TRADEMARK OFFICE

CERTIFICATE OF CORRECTION

PATENT NO. : 5,059,935
DATED : October 22, 1991
INVENTOR(S) : Koichi Ohsawa, et. al.

It is certified that error appears in the above-indentified patent and that said Letters Patent is hereby corrected as shown below:

Title page, item [30], add the following: under Foreign Application Priority Data, July 6, 1990 [JP] Japan..... 2-180323--.

Signed and Sealed this

Fifth Day of April, 1994

Bruce Lehman

*Attest:*

BRUCE LEHMAN

*Attesting Officer*

*Commissioner of Patents and Trademarks*